US012667200B2

(12) United States Patent
Eskridge, III et al.

(10) Patent No.: US 12,667,200 B2
(45) Date of Patent: Jun. 30, 2026

(54) FOLDABLE ADJUSTABLE BED FRAME

(71) Applicant: Star Seeds Co. LTD, Changhua County (TW)

(72) Inventors: Horace Robert Eskridge, III, Nicholasville, KY (US); Chuan Huang Shih, Changhua County (TW); Yu-Chi Yang, Changhua County (TW)

(73) Assignee: Star Seeds Co. LTD, Changhua County (TW)

( * ) Notice: Subject to any disclaimer, the term of this patent is extended or adjusted under 35 U.S.C. 154(b) by 143 days.

(21) Appl. No.: 18/754,404

(22) Filed: Jun. 26, 2024

(65) Prior Publication Data

US 2026/0000212 A1 Jan. 1, 2026

(51) Int. Cl.

| | |
|---|---|
| ***A47C 19/12*** | (2006.01) |
| ***A47C 19/04*** | (2006.01) |
| ***A47C 20/04*** | (2006.01) |

(52) U.S. Cl.

CPC ..... *A47C 19/12* (2013.01); *A47C 19/04* (2013.01); *A47C 20/04* (2013.01)

(58) Field of Classification Search

CPC ..... A47C 19/12; A47C 19/04; A47C 20/04; A47C 19/122; A47C 20/08; A47C 17/70; A47C 19/021; A47C 20/043; A47C 27/14

USPC ..... 5/618

See application file for complete search history.

(56) References Cited

U.S. PATENT DOCUMENTS

| | | | | |
|---|---|---|---|---|
| 3,108,291 | A * | 10/1963 | Eason | A47C 17/68 5/150.1 |
| 7,111,340 | B2 * | 9/2006 | Mitchell | A61G 3/029 5/430 |
| 7,444,696 | B2 * | 11/2008 | Lin | A61G 7/015 5/430 |
| 9,226,588 | B2 | 1/2016 | McCarty et al. | |
| 10,463,163 | B1 | 11/2019 | Aramli et al. | |
| 11,399,998 | B2 * | 8/2022 | Shih | A47C 20/041 |
| 11,744,380 | B2 | 9/2023 | Eskridge et al. | |
| 11,766,131 | B2 * | 9/2023 | Bellingroth | A47C 20/041 5/618 |

(Continued)

*Primary Examiner* — Myles A Throop

(74) *Attorney, Agent, or Firm* — Michael Coblenz

(57) ABSTRACT

A foldable and adjustable one-piece King and California King bed frame that includes a bottom frame and a multi-sectional adjustable frame having left and right extension portions that allow the frame to adjust between King and California King sized beds, and allows the bed to be folded to a relatively small size for shipping. The adjustable frames have two transverse extension portions and a longitudinal rod connected with the two transverse extension portions, and the extension frames have two support arms and two stopping portions disposed with the two support arms, and two linkages each having two ends pivotally connected with the associated transverse extension portion and support arm in a way that the two linkages are abutted against top edges of the stopping portion and longitudinal rod. The extension frame is upwardly foldable together with the linkages to swing to the top side of the adjustable frames to reduce the width of the frame, and when they are folded down also minimize the thickness of the folded frame. As a result, the package size of the bed frame may be classified into a lower charging category for transportation, thereby reducing costs and enhancing market competitiveness.

7 Claims, 7 Drawing Sheets

(56) References Cited

U.S. PATENT DOCUMENTS

| | | | | |
|---|---|---|---|---|
| 12,082,699 | B2 * | 9/2024 | Zeng | A47C 19/12 |
| 12,089,745 | B2 * | 9/2024 | Xie | A47C 19/122 |
| 2009/0293197 | A1 * | 12/2009 | Larson | A61G 7/002 5/613 |
| 2014/0250600 | A1 | 9/2014 | McCarty et al. | |
| 2014/0366267 | A1 * | 12/2014 | Suh | A47C 20/041 5/174 |
| 2017/0360209 | A1 * | 12/2017 | Zhou | A47C 20/041 |
| 2018/0332973 | A1 * | 11/2018 | Choi | A47C 19/025 |
| 2019/0174928 | A1 * | 6/2019 | Choi | B65D 85/64 |
| 2020/0078238 | A1 * | 3/2020 | Huang | A61G 7/012 |
| 2020/0237105 | A1 * | 7/2020 | Eskridge, III | A47C 27/14 |

* cited by examiner

FOLDABLE ADJUSTABLE BED FRAME

CROSS REFERENCE TO RELATED APPLICATIONS

Not applicable.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

Field of the Invention

The present invention relates generally to the adjustable components of a bed frame, and more particularly, to an adjustable width extension frame that can be adjustable between a large sized frame such as a King and a California King size bed frame, and that also has the ability to be folded to meet the dimensional weight (L+2W+2H) requirements for low-cost shipping with major shippers.

Description of the Related Art

Conventional bedding products like bases, fixed foundations, adjustable foundations and mattresses, are typically purchased on site at a store. The purchased bedding products then need to be delivered to the purchaser's home, and certain bedding products require some in-home assembly or set-up. The size and weight of conventional bedding products make transportation, assembly, and set-up difficult for the purchaser. This difficulty increases as the size and weight of the bedding products increase, most particularly for king and California king size beds.

The growth of online, e.g., web-based and direct-to-consumer, shopping creates an opportunity and need for bedding products that can be shipped and delivered directly to consumers using common shipping carriers. The ability to use these common carriers, and the cost associated with shipping, is governed by size and weight restrictions imposed by the carrier. The size and weight of conventional bedding products, and in particular adjustable bedding products, limit the shipping methods or carriers that can be used for delivery due to these size and weight restrictions. This creates a need for bedding products, and in particular larger sized bedding products, like King and California King sized beds, that are foldable to a smaller size that can meet these shipping requirements.

Conventional beds are typically sized to meet specific usage requirements. For example, a single bed is approximately 105 centimeters wide and 188 centimeters long (American size is 54×75 inches), a queen-size bed is approximately 152 centimeters wide and 188 centimeters long (American size is 60×80 inches), a king-size bed is approximately 193 centimeters wide and 203 centimeters long (American size is 76×80 inches), and a California King is approximately 183 centimeters wide and 213 centimeters long (American size is 72×84 inches).

Smaller sized bed frames easily fall within the dimensional weight requirements for lower cost shipping, but typically the larger sized bed frames, particularly the King and California King sized frames do not readily fall within those requirements. For bed frame manufacturers, reducing packaging dimensions to meet the category of lower shipping costs for transportation and for warehousing becomes crucial to saving costs, thereby affecting whether the final market price is acceptable to consumers. Especially, with the popularity of online sales, more and more consumers are using express delivery companies. If the dimensions of the packaging exceed relevant specifications, shipping costs may increase by hundreds of US dollars via surcharges above the allowed dimensional weights.

Difficulties associated with in-home assembly of bedding products and the need to meet the size and weight restrictions imposed by shipping carriers create a desire for bedding products, including adjustable bedding products, that are cost-effectively shipped directly to an end consumer using a low-cost carrier. These bedding products would fit within the existing size and weight restrictions of those carriers and would be easily assembled by the consumer.

SUMMARY OF THE INVENTION

The present invention is drawn to the extension components that allow a large sized bed frame to be folded to a smaller size to meet shipping requirements. It is an objective of the present invention to provide an adjustable large sized bed frame, specifically a one-piece King or California King, which can reduce its width, such that the packaging dimension may fall within lower shipping fee categories for transportation, thereby reducing costs to enhance market competitiveness. The bed assembly has a clamshell arrangement of components that are interconnected with hinges or hinged connections to provide for ease of assembly, and that also allows the components to be folded down to the smallest possible size for shipping. The resulting compact folded configuration of the bed assembly has a size, i.e. length, width, and height, that complies with, and in generally less than, the size and weight restrictions for shipping direct to the customer using common shipping carriers.

To attain the above and other objectives, the present invention provides a solution for the one-piece King and California King width adjustable bed frame comprising a main frame, an adjustable frame disposed on the main frame, and an extension frame attached to the adjustable frame by two linkages. The relevant portion of the adjustable frame includes two transverse extension portions parallel to each other, and a longitudinal rod connected with the two transverse extension portions. The extension frame includes two support arms corresponding in position to the two transverse extension portions of the main frame, and two stopping portions disposed with the two support arms, respectively. Each of the linkages has two ends pivotally connected with associated one of the two transverse extension portions and one of the two support arms in a way that each of the two linkages is abutted against top edges of one of the stopping portions and one of the longitudinal rods. Wherein, the extension frame is upwardly foldable together with the two linkages to swing to a top side of the adjustable frame in a way that the two support arms are in contact with the two transverse extension portions, thereby reducing the width of the bed frame, and with the extension frame laying flat and directly on the surface of the adjustable frame, also minimizing the overall thickness. As a result, the packaging dimension of the bed frame, when fully folded, will fall within lower shipping fee categories for transportation thanks to the advantage that the width one piece King and California King bed frame is adjustable, thereby reducing costs and enhancing market competitiveness.

The present invention is a large sized adjustable bed frame configured to be foldable for easy shipping, said adjustable bed frame comprising: a bottom frame having a top surface and a bottom surface; a multi-sectional adjustable frame disposed on said bottom frame top surface, said multi-sectional adjustable frame consisting of an adjustable back frame, a first fixed hip frame, a second fixed hip frame, an adjustable thigh frame, and an adjustable calf frame, each of said multi-sectional adjustable frames having a left side and a right side; a multiplicity of extension frames rotatably attached to the adjustable frames; wherein said bottom frame consists of a U-shaped front frame and a U-shaped rear frame foldably attached to each other by means of a main frame hinge; said U-shaped front frame having two front frame arms and a front frame cross bar attached between said front frame arms, and said U-shaped rear frame having two rear frame arms and a rear frame cross bar attached between said rear frame arms, wherein said U-shaped rear frame is smaller than the U-shaped front frame such that said U-shaped rear frame can fold and fit within said U-shaped front frame; said U-shaped front frame and a U-shaped rear frame further having a top surface and a bottom surface; wherein said first fixed hip frame is attached to said top surface of said front frame, said adjustable back support frame is rotatably attached to said first fixed him frame, said second fixed hip frame is attached to the top surface of said rear frame, said adjustable thigh frame rotatably attached to said second fixed hip frame, and said adjustable calf frame rotatably attached to said adjustable thigh frame; wherein said adjustable back frame has a left and right side extension frames foldably attached thereto, said first fixed hip frame has a left and right side first fixed extension frames attached thereto, said second fixed hip frame has a left and a right side second fixed hip extension frames foldably attached thereto, said adjustable thigh frame has a left and right side thigh extension frames foldably attached thereto, and said adjustable calf frame has a left and right side calf extension frames foldably attached thereto; wherein said extension frames fold against a top surface of said adjustable frames to reduce the width of the frame with minimal thickness; and wherein when said adjustable frames are folded flat, said extension frames are folded onto said adjustable frames, and said bottom frames are folded together, the overall dimensions of the bed frame are of a size to accommodate shipping.

In the foldable and adjustable bed frame of the present invention, each of said adjustable frames further have a left and a right side, both sides having: two transverse extension portions parallel to each other, and a longitudinal rod connected with the two transverse extension portions; said extension frame having two support arms corresponding in position to the two transverse extension portions of the adjustable frame, and two stopping portions disposed with the two support arms, respectively; and two linkages each having two ends pivotally connected with associated one of the two transverse extension portions and one of the two support arms in a way that each of the two linkages is abutted against a top edge of one of the stopping portions and a top edge of one of the longitudinal rods; wherein the extension frame is upwardly foldable together with the two linkages to swing to a top side of the adjustable frame in a way that the two support arms are in contact with the two transverse extension portions, thereby reducing the overall width of the bed frame, with a minimal increase in thickness of the folded frame. In this adjustable bed frame the two linkages are located between the two transverse extension portions and between the two support arms, and the two stopping portions extend outwardly from the two support arms towards each other, and the two stopping portions are provided at bottom edges of the two support arms, respectively. Additionally, the longitudinal rod is provided at bottom edges of the two transverse extension portions, respectively. This adjustable bed frame also includes a multiplicity of leg posts removably attached to said bottom frame bottom surface, and a back frame actuator disposed between said adjustable back frame and said bottom frame top surface to allow the rotatable movement of said adjustable back frame on said first fixed hip frame to allow the adjustment of said adjustable back frame; and a thigh frame actuator disposed between said adjustable thigh frame and said bottom frame top surface to allow the rotatable movement of said adjustable thigh frame on said second fixed hip frame to allow the adjustment of said adjustable thigh frame.

BRIEF DESCRIPTION OF THE DRAWINGS

The present invention will become more fully understood from the detailed description given herein below and the accompanying drawings which are given by way of illustration only, and thus are not limitative of the present invention, and wherein.

DETAILED DESCRIPTION OF THE INVENTION

Detailed embodiments of the present invention are disclosed herein. It is to be understood that the disclosed embodiments are merely exemplary of the invention, and that there may be a variety of other alternate embodiments. The figures are not necessarily to scale, and some features may be exaggerated or minimized to show details of particular components. Therefore, specified structural and functional details disclosed herein are not to be interpreted as limiting, but merely as a basis for teaching one skilled in the art to employ the varying embodiments of the present invention.

Figure 1:
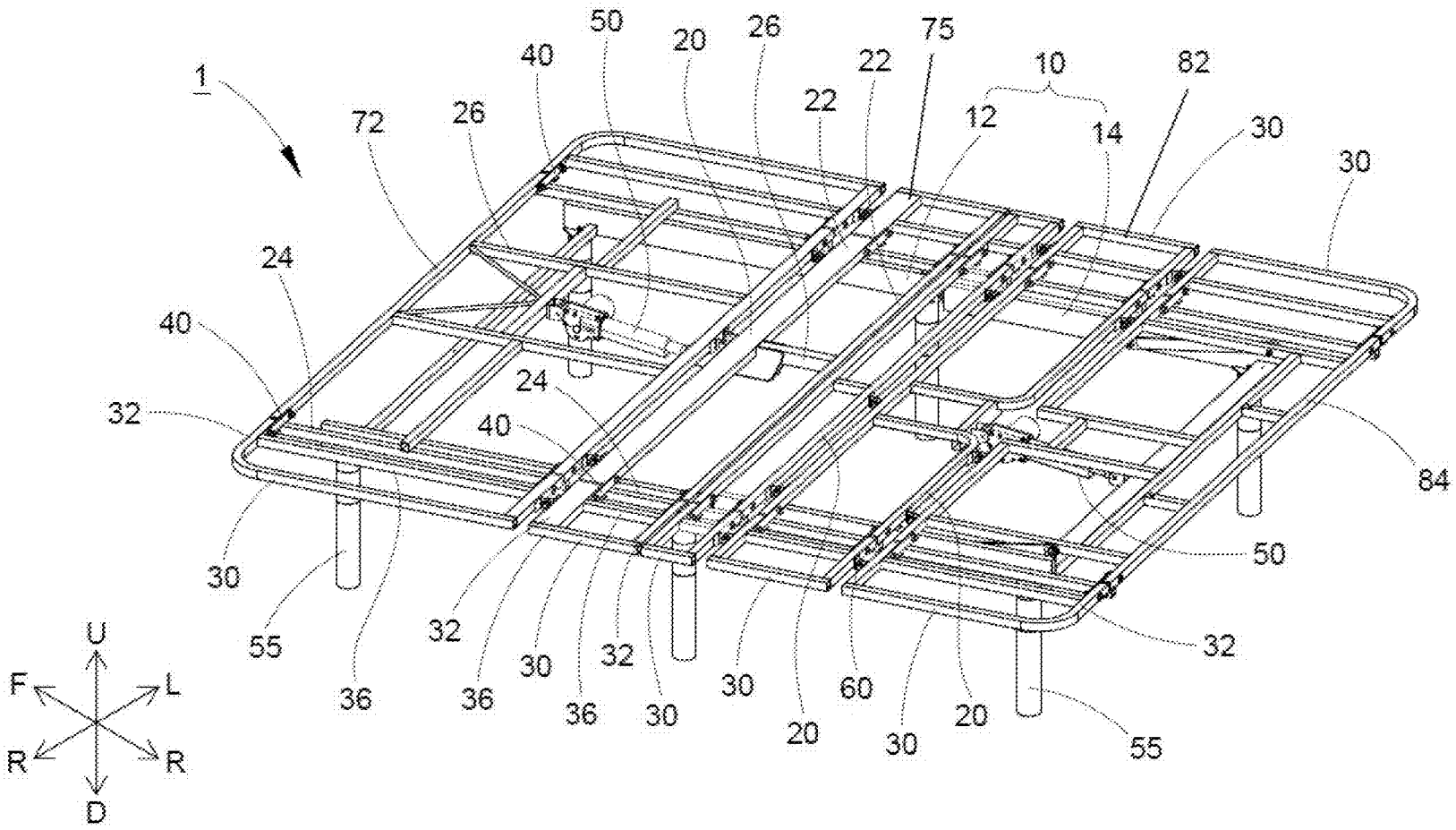
FIG. 1 is a perspective view of a width adjustable bed frame according to a preferred embodiment of the present invention.
Figure 2:
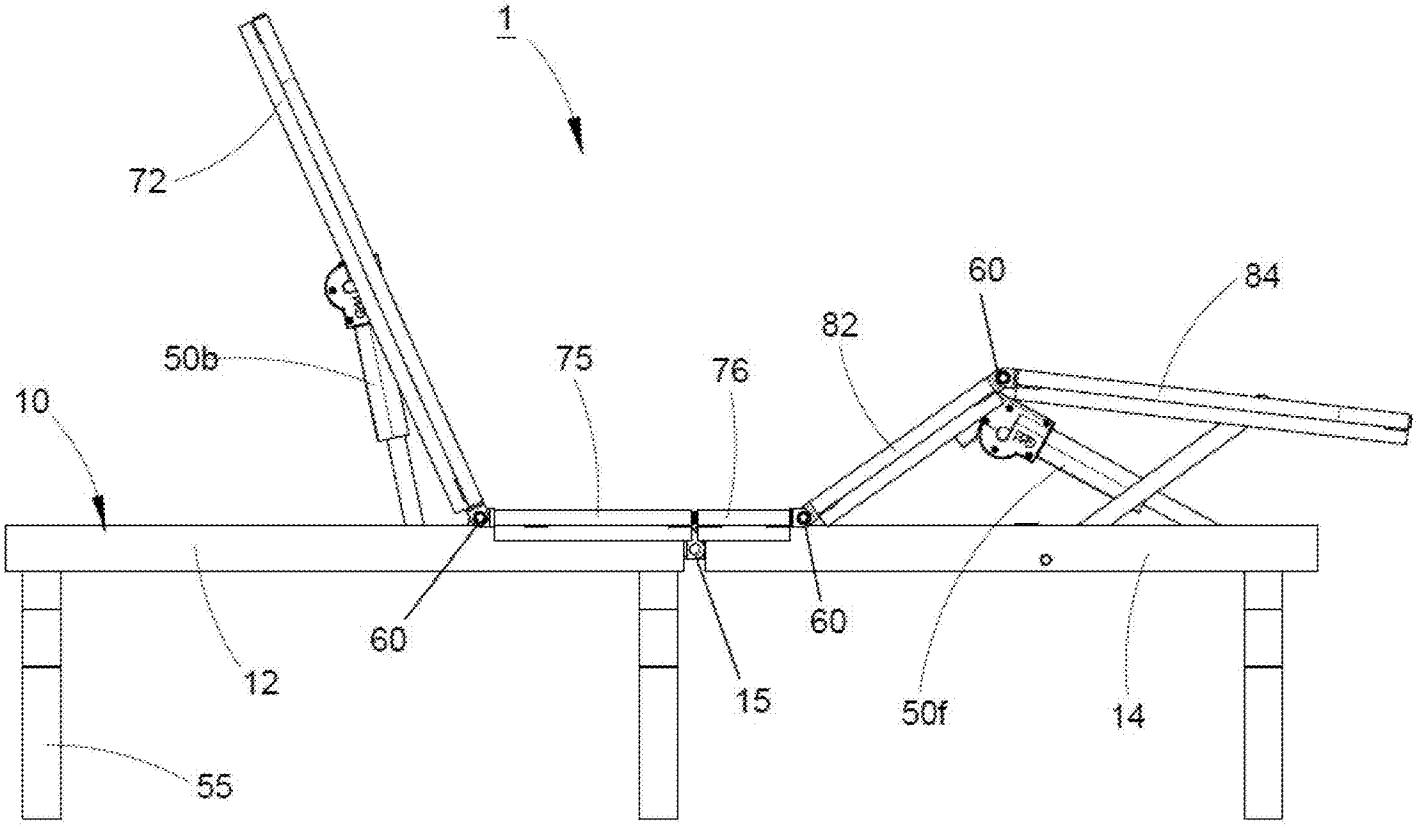
FIG. 2 is a side view showing the adjustable components of bed frame in a state of use.

The structure and technical features of the present invention will be described in detail hereunder by an embodiment and accompany drawings. As shown in FIGS. 1-2, the one-piece King and California King large sized adjustable bed frame 1 provided by a preferred embodiment of the present invention is composed of a bottom frame 10 and five adjustable frames 20 positioned on the bottom frame 10. There are also ten extension frames 30 arranged in pairs on the left and right sides of each of the associated adjustable frames 20, with twenty hinged linkages 40 connecting the adjustable frames 20 and the extension frames 30. There are also two actuators 50*b* and 50*f* that move portions of the adjustable frames 20 in relation to the bottom frame 10, as well as six leg posts 55 attached to the bottom surface of the bottom frame 10.

For convenient and concise illustration, the term "front" (F) herein refers to the direction of the head of the bed, and "rear" (R) refers to the direction of the foot of the bed. The directions "front" (F), "rear" (R), "left" (L), "right" (R), "up" (U), and "down" (D) of the bed frame are indicated by the reference arrows in FIG. 1, but should not be construed as limiting the scope of the patent. As used herein, the "top surface" refers to the upward surface of a component in the standard configuration with the frame 1 on a floor, and the "bottom surface" refers to the underside surface of a component when the frame 1 is on the floor. The surfaces remain the "top surface" or the "bottom surface" even when the components are folded and no longer in the standard orientation. As used herein, the term "transverse" is used to mean side to side, i.e. left to right or right to left, and the term "longitudinal" to mean from front to rear, or in the direction from the head to the foot, or foot to head, of the bed frame.

As shown in FIG. 1 and FIG. 2, the bottom frame 10 consists of a front frame 12 and a rear frame 14 that are pivotally connected to each other by a main frame hinge 15. The bottom frame 10 and the component front frame 12 and rear frame 14 have top surfaces and bottom surfaces. The front frame 12 is U-shaped, with a cross bar forming the bottom of the U and two arms forming the uprights of the U, and with its opening facing rearward. The rear frame 14 is U-shaped, with a cross bar forming the bottom of the U and two arms forming the uprights of the U, and with its opening facing forward. The rear frame 14 is slightly smaller than the front frame 12, with the cross bar of the rear frame 14 having a slightly smaller width. This allows the rear frame 14 to sit inside the front frame 12, and the be attached by two main frame hinges 15 attached at the ends of the arms of each frame 12 and 14. Each arm end of the rear frame 14 and front frame 12 has a hole running therethrough, and the main frame hinge 15 is a carriage type bolt running therethrough with bushings and washers, or other similar rotatable linkages, that allow the front frame 12 and rear frame 14 to rotate on each other. As noted, the rear frame 14 is slightly smaller than the front frame 12 and so fits within the front frame 12 when the components are folded together. This minimizes the overall thickness of the frame 1 when folded.

The adjustable frames 20 are positioned above and on the top surface of the bottom frame 10 and serve as the support for the bedding material such as a mattress. The adjustable frames 20 consist of a back support frames 72 (the first adjustable frame 20 counted from the head of the bed), the hip support frame 74, which consists of two parts, the first fixed hip frame 75 and the second fixed hip frame 76 (as counted from the head of the bed), the thigh support frames 82 (the fourth adjustable frame 20 counted from the head of the bed), and calf support frames 84 (the fifth adjustable frame 20 counted from the head of the bed). The two hip support frames are attached to the bottom frame 10, with the first fixed hip frame 75 fixedly attached to the front frame 12, and the second fixed hip frame 76 fixedly attached to the rear frame 14. These frames 75 and 76 are attached in the conventional manner, which can include bolting or welding or the like. The back support frame 72 is pivotally connected to the first fixed hip frame 75 by means of the pivoting attachment 60, which allows the back support frame 72 to rotate upward as desired by the user. The thigh support frame 82 is pivotally connected to the second fixed hip frame 76 by means of the pivoting attachment 60, which allows the thigh support frame to rotate upward, and the calf support frame 84 is pivotally connected to the thigh support frame 82 by means of the pivoting attachment 60. Details of the pivoting attachment 60 connecting each of the frames 20 are described in more detail below.

The framing members, meaning the bottom frames 10, the adjustable frames 20, and the extension frames 30, are made from sturdy but lightweight materials. The types of framing members include hollow tubular members having circular or rectangular cross sections. Additional weight reduction is achieved with reduced thickness, i.e., wall thickness, of the material of the framing member. Suitable materials for the framing members include, but are not limited to, metals including steel, aluminum, and chrome-molybdenum, plastics, polymers, carbon fiber and combinations thereof.

As seen in FIG. 1, each of the adjustable frames 20 (72, 75, 76, 82, and 84) are rectangular frames made from a series of longitudinal rods 24 and transverse rods 22, to form the adjustable frames 20. The adjustable frames 20 are the same width, side to side, but are different lengths to correspond to their position on the frame 1 and the resulting bed. As shown in FIG. 2, the adjustable frames 20 are situated on the top surface of the bottom frame 10, and are movable and rotatable to allow the user of the bed to adjust the orientation of the back and legs for comfort. The adjustable frames 20 also have top surfaces and bottom surfaces, with the bottom surface of the adjustable frame 20 either affixed to the top surface of the bottom frame 10, or resting on the top surface of the bottom frame 10 when in the flat position. As noted above, the bottom surface of the hip support frame 74 is fixedly attached to the top surface of the bottom frame 10, with the first fixed hip frame 75 fixedly mounted to the front frame 12, and the second fixed hip frame 76 fixedly mounted to the rear frame 14. The back support frame 72 is rotatable attached to the first fixed hip frame 75 by means of the pivoting attachment 60, and the thigh support frame 82 is rotatably attached to the second fixed hip frame 76 by means of the pivoting attachment 60. Finally, the calf support frame 84 is rotatably attached to the thigh support frame 82 by means of the pivoting attachment 60.

The two actuators, the back support actuator 50*b* and the foot support actuator 50*f* are pivotally mounted at their respective ends on the bottom frame 10. Specifically the back support actuator 50*b* is attached at one end to the back support frame 72 and at the other to the front frame 12, so that the back support frame 72 can rotate upward when the actuator 50*b* is extended. The foot support actuator 50*f* is attached at one end to the thigh support frame 82 and at the other to the rear frame 14, such that the thigh support frame 82 can rotate upward relative to the bottom frame 10 when the actuator 50*f* is extended. As shown in FIG. 2, the back support frame 72 rotates around the pivot attachment 60 at the hip support frame 74. The back section actuator 50*b* moves, adjusts or articulates the back section support frame 72 with respect to the front frame 12, as shown in FIG. 2. In one embodiment, the back support actuator 50*b* and foot support actuators 50*f* are a linear actuator. Suitable linear actuators are known and available in the art. Therefore, extending and retracting the linear actuator moves the back section support frame 72 between the flat position and the adjusted or raised position. In the flat position the two actuators 50*b* and 50*f* are completely contained between the decking of the back support frame 72 and the front frame 12, and the calf support frame 84 and the rear frame 14. The two actuators 50*b* and 50*f* are offset transversely so that when the bottom frame 10 is folded the two actuators sit side by side and don't conflict. This provides zero clearance and flat surfaces when the rear frame 14 is folded into the front frame 12 for packaging and shipping and minimizes the overall thickness of the bottom frame for the compact assembly of the bed base.

Figure 4:
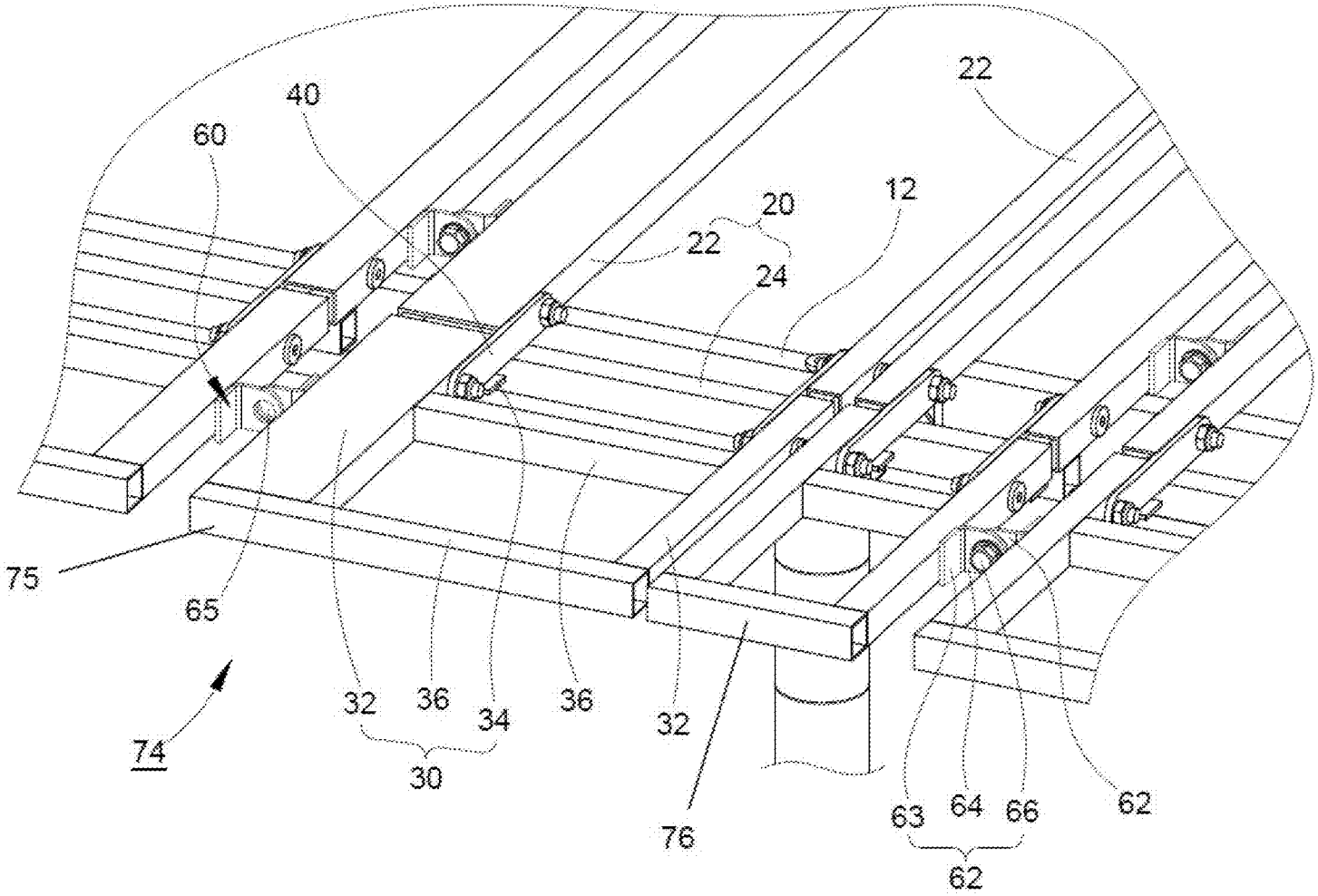
FIG. 4 is an enlarged view of a part of the width adjustable bed frame highlighting the extension frame components.

Details of the pivoting attachments 60 are shown in FIG. 4. The pivoting attachment 60 includes two pivot portions 62 respectively disposed on the respective frame components. Each pivot portion 62 is L-shaped and has a baseplate 63 fixedly attached to the frame, an upright plate 64 extending vertically from the baseplate 63, and a through hole 65 formed at the upright plates 64. The through holes 65 of adjacent two pivot portions 62 are aligned with or aimed at each other and are penetrated by a retaining member 66, which may be a bolt, a pin, or an equivalent member thereof, so that the upright plates 64 can rotate on each other, which means that the adjacent frame can movably rotate in relation to each other. When the back actuator 50*b* is activated, the back support frame 72 rotates up about the pivoting attachment 60 connected to the second adjustable frame 75.

Figure 3:
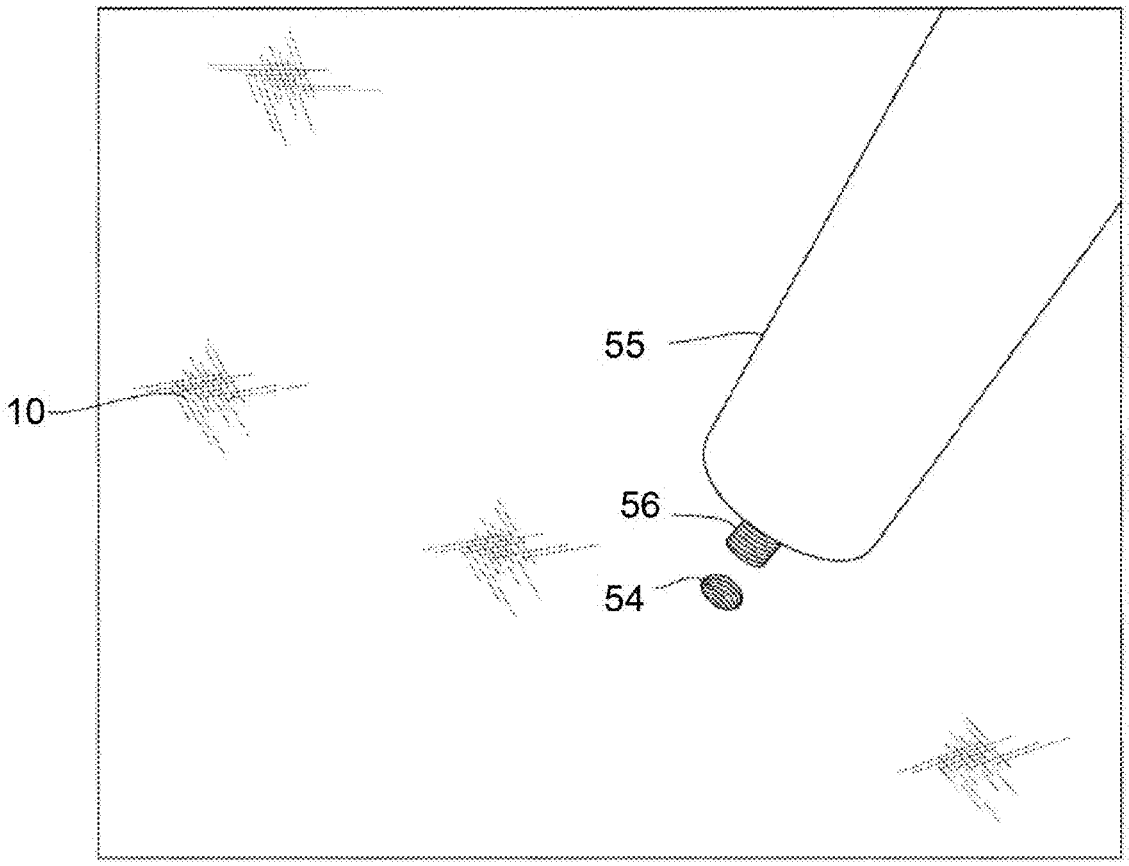
FIG. 3 is an enlarged bottom perspective view of a leg post attachment to the underside of the bed frame.

There are six leg posts 55 that are removably mounted on the bottom surface of the bottom frame 10 to elevate the bottom frame 10, as shown in FIG. 3. They are removably mounted so that they can be removed before the bottom frame 10 is folded. The leg posts 55 can have a fixed length or can be adjustable leg assemblies with adjustable lengths. Each leg post 55 is removably attachable to one of the plurality of bed sections. In one embodiment, releasable attachment of the leg assemblies is provided by a threaded attachment, as shown in FIG. 3, however, any suitable arrangement for providing removable leg assemblies to bed bases can be used. In one embodiment, nuts 54 are incorporated into the bottom surface of the main frame 10, and a corresponding bolt 56 is incorporated into the leg post 55 so that the leg posts can be screwed in to attach to the frame. As illustrated, in FIGS. 1-4, the frame 1 includes six leg posts 55. Two leg post are attached to the front and on each side of the front frame 12, the foot section of the rear frame 14, and the center section at the end of the arms of the front frame 12. In particular, the leg assemblies are attached at the corners of the head section and foot section fixed frames and on either side of a center beam running through the center section. The leg posts 55 can be unscrewed before the frame 1 is folded, and then placed inside the space of the folded frame for shipping.

Each of the five adjustable frames 20, very in length, from front to rear, with the back support frame 72 long, the first fixed hip frame 75 fairly narrow, the second fixed hip frame short, the thigh support frame 82 moderately long, and the calf support frame 84 slightly longer than the thigh support frame 82. It should be noted, however, that the specific configuration of these adjustable frames are not specifically germane to this invention. The important feature for this invention is the foldable extension frames 30 attached to each adjustable frame 20 and that fold in to reduce the overall width of the frame 1. The corresponding extension frames 30 are the same length as the corresponding adjustable frames 20. Therefore, for simplicity, the first fixed hip frame 75 and its associated extension frame 30, as shown in FIG. 4, is described in detail to show how the components attach and rotate. The adjustable frame 20 has two transverse extension portions 22 parallel to each other, and two longitudinal rods 24 connecting the two transverse extension portions 22. It is to be noted that these frame components vary in size and width based on their position within the frame 1, but the operation of the attachments and the extension frame 30 is the same, so those differences are not relevant to the invention. The two transverse extension portions 22 are shown, in this embodiment, as straight bars extending in the left-and right direction and arranged in front-to-back order, while the two longitudinal rods 24 extend in the back-and-front direction and are respectively mounted at the bottom edges of the two transverse extension portions 22. There are two extension frames 30 for each adjustable frame 20, and are located at both the left and right sides of the adjustable frame 20. It is possible for one or both extension frames 30 to be folded in individually to adjust the overall width of the frame 1. Other adjustable frames 20 may be equipped with one or more reinforcement rods 26 to provide sufficient structural strength, and the transverse extension portions 22 may have shapes other than straight bars.

The extension frames 30 are positioned on the left and right sides of the adjustable frames 20 in pairs, so one on the left and one on the right, which allows the frames to be extended side to side to allow it to fit either a standard King size mattress or a California King sized mattress. Due to the structural similarity of these extension frames 30, for clarity the second right extension frame 30 connected to the first fixed hip frame 75 is used as an example. The extension frames 30 also have top surfaces and bottom surfaces. As shown in FIG. 4, the extension frame 30 has two support arms 32, which correspond to and are positioned to be transverse extensions of portions 22 of the adjustable frame 20, two longitudinal extension portions 36 connected with the two support arms 32, and two stopping portions 34 respectively provided at the bottom edges of the two support arms 32. The two support arms 32 are shown, in this embodiment, as straight bars extending in the left-and-right direction, and the two stopping portions 34 are thick plates extending outwardly from the two support arms 32 in opposite directions towards each other. The two longitudinal extension portions 36 are shown, in this embodiment, as straight bars extending in the back-and-front direction, and used to fix the two support arms 32, providing sufficient structural strength to the extension frame 30. The size and shape of other extension frames 30 may vary depending on the size of the corresponding adjustable frame 20, and so are the same length as the corresponding back support frame 72, first fixed hip frame 75, second fixed hip support frame 76, thigh support frame 82 and calf support frame 84.

Figure 6:
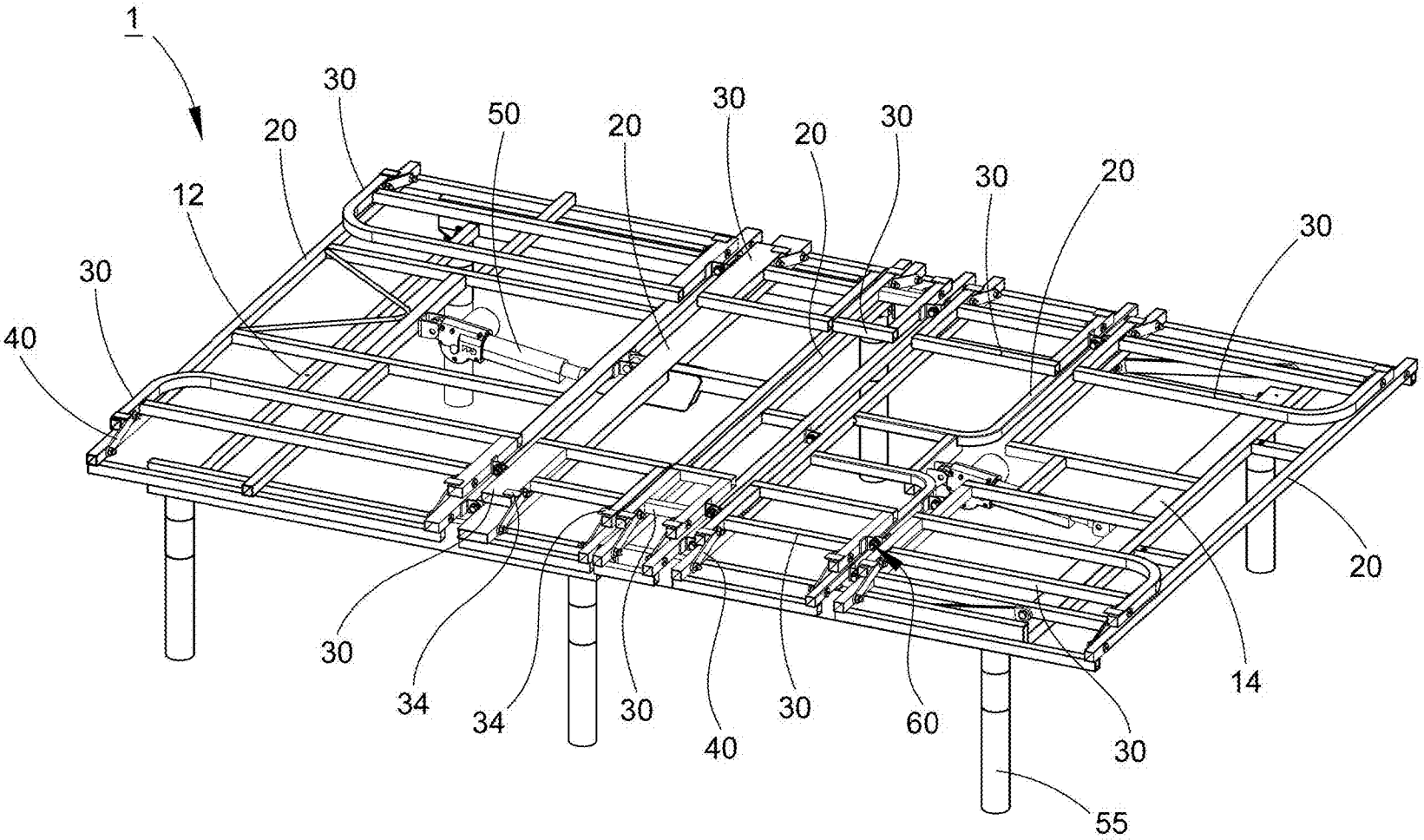
FIG. 6 is a perspective view of the width adjustable bed frame showing all of that the extension frames of the bed frame are in a folded state.

The rotatable linkages 40 are used to connect the associated adjustable frames 20 and extension frames 30. Because the structures of these rotatable linkages 40 are identical on all extension frames 30, the two rotatable linkages 40 used to connect the first fix hip frame 75 and the second right extension frame 30 are taken as an example for illustration purpose. Each rotatable linkage 40 is a bar that has two ends pivotally connected with inner sides of paired one of the transverse extension portions 22 of the adjustable frame 20 and one of the support arms 32 of the extension frame 30. In other words, the two rotatable linkages 40 are positioned between the two transverse extension portions 22 and between the two support arms 32 to rotatably attach the extension frame 30 to the corresponding adjustable frame 20. Each rotatable linkage 40 abuts against the top edge of one of the stopping portions 34 and the top edge of one of the longitudinal rods 24. Thus, the rotatable linkage 40 is supported by the longitudinal rod 24 and maintains its horizontal position, while the stopping portion 34, which is restricted by the rotatable linkage 40, enables the support arm 32 to be maintained at a horizontal position. In this way, the extension frame 30 is in an extended, unfolded state on the right side of 20 the main frame 20, and the top edges of the support arms 32 are substantially flush with the top edges of the transverse extension portions 22. As shown in FIG. 6, this allows the width of the overall bed frame 1 to be increased by folding the extension frames 30 out, and decreased by folding the extension frames 30 in.

Figure 5:
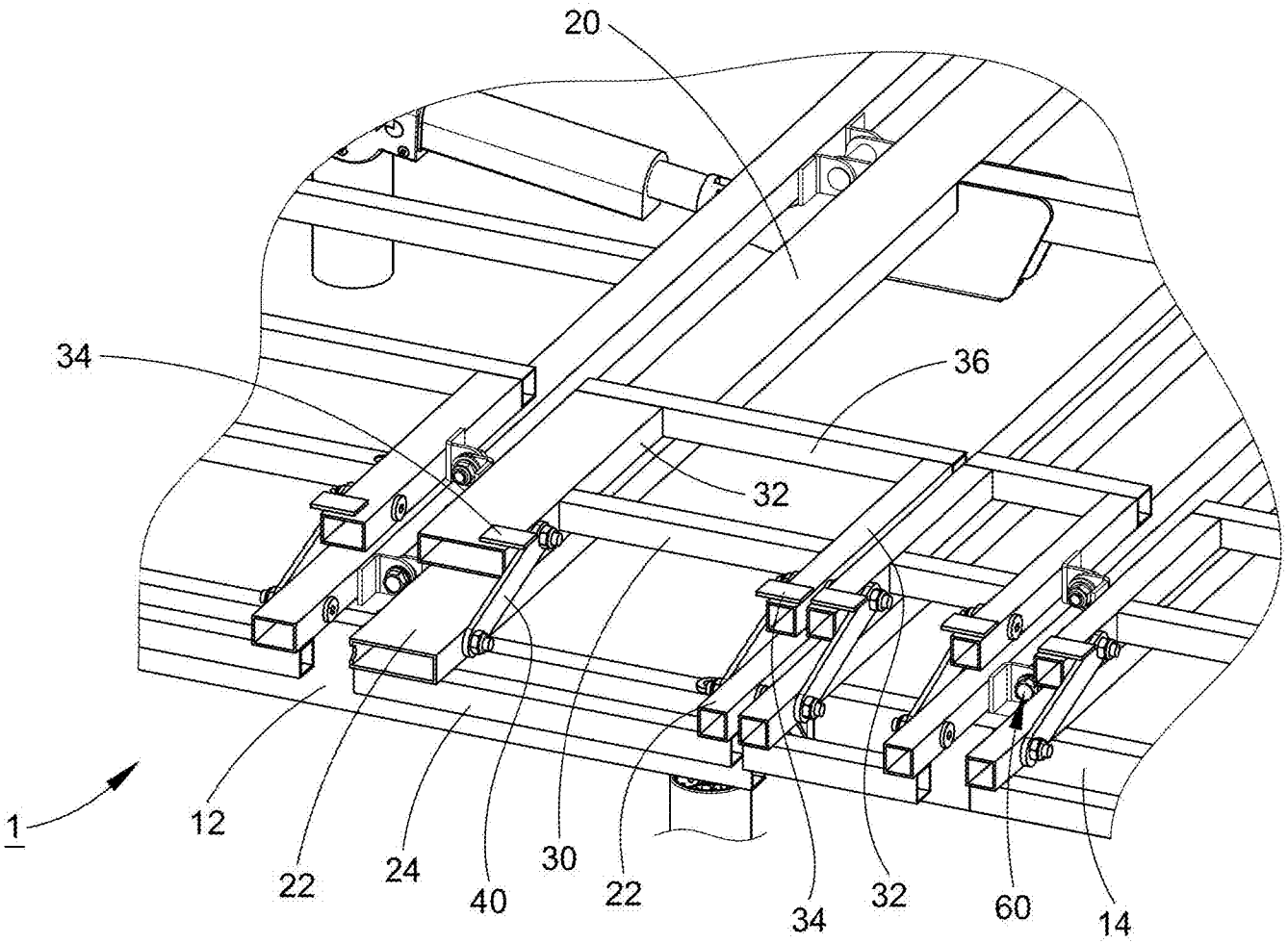
FIG. 5 is an enlarged view of a part of the width adjustable bed frame shown in FIG. 4, with the extension frame folded onto the adjustable frame to reduce the width of the bed frame.

With the above-described structural design, each of the extension frames 30, together with the associated rotatable linkages 40 thereof, can be upwardly rotated and swung to the top surface of the adjustable frame 20 in such a way that the top surface of the two support arms 32 are in contact with the top surfaces of the two transverse extension portions 22 respectively, with the support arms 32 laying flat against the transverse extension portions 22, thus folding in to reduce the width, but configured to also minimize the overall thickness of the folded frame 1. FIG. 5 is a detail showing the extension frame 30 folded over and onto the adjustable frame 20. This also reduces the overall width of the bed frame 1, as shown in FIG. 6, which shows the full bed frame 1 with all of the extension frames 30 folded onto the corresponding adjustable frames 20. When the extensions 30 are folded on both the left and right side, the overall width of the frame 10 be reduced from 189 cm to 138 cm. If the front frame 12 and the rear frame 14 are further folded together, the length of the frame 1 will be reduced to half of its original length. For example, the length may be reduced from 212 cm to 106 cm.

Figure 7:
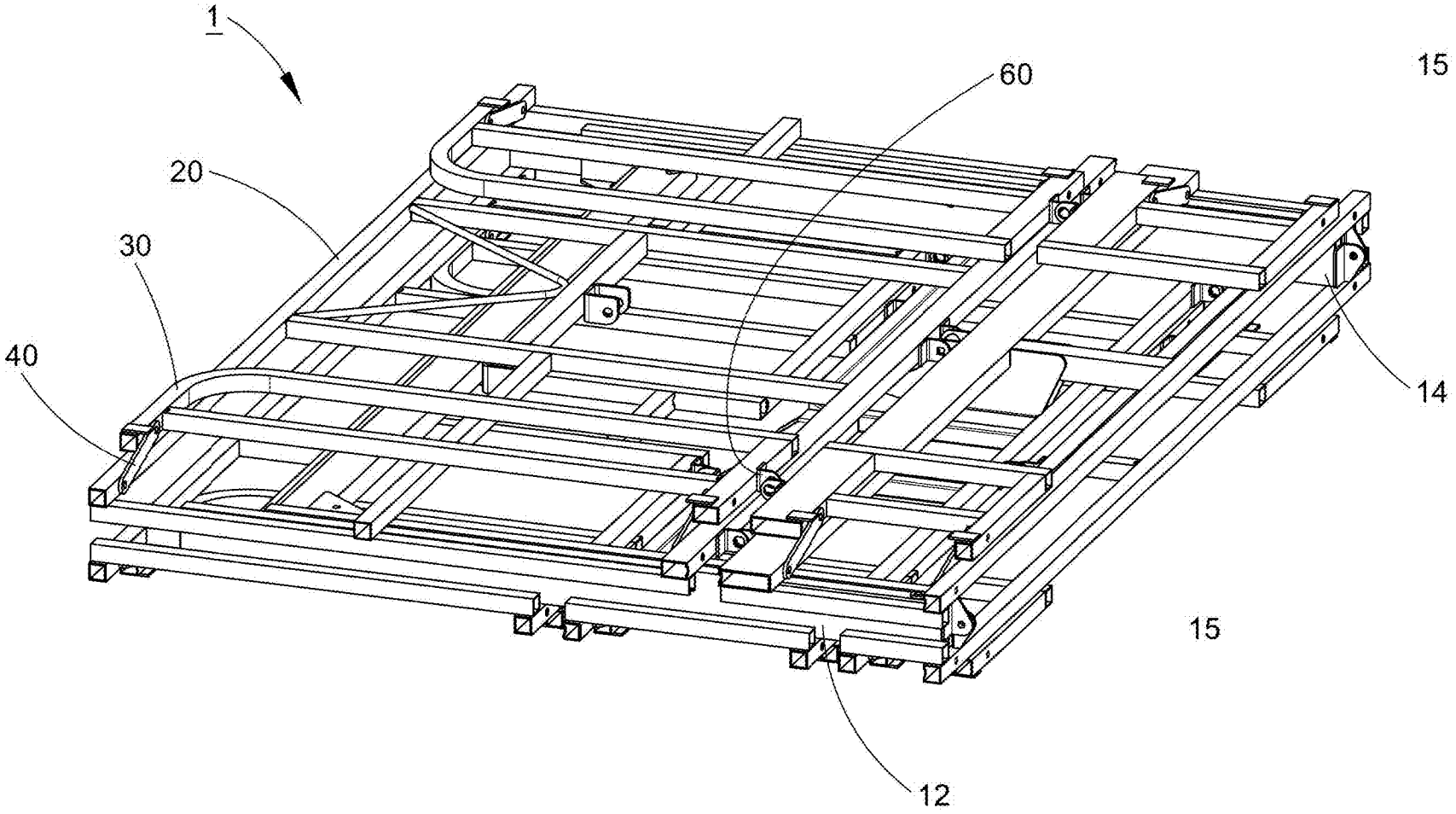
FIG. 7 is a perspective view of the width adjustable bed frame with the extension frames folded, and the bottom frame folded, thus the entire bed frame is in a folded state.

To fully fold the frame 1, as shown in FIG. 7, the actuator **50*b* is activated and the adjustable back frame 72 is positioned flat on the front frame 12, the actuator 50*f* is activated and the adjustable thigh support frame 82 is rotated down, and the adjustable calf support frame 84 rotates with it, and both are positioned flat against the rear frame 14. The extension frames 30 are folded up and onto the corresponding adjustable frames 20. The leg posts 55 are unscrewed from the bottom surface of the bottom frame 10. The rear frame 14 is rotated downward and folds into the front frame 12. As a result, the packaging dimension of the bed frame 1** will fall within a lower shipping fee category for transportation, thereby reducing costs and enhancing market competitiveness so as to achieve the objectives of the present invention.

To accelerate the folding speed and improve structural stability, a pivoting attachment 60 may be provided between adjacent two extension frames 30 of the width adjustable bed frame 1, which connects the adjacent two extension frames 30 together so that they can swing relative to the main frames 20 together. The pivoting attachment 60 is also the attachment between the back support frame 27 and the first fixed hip frame 75, the second hip fixed frame 76 and the thigh support frame 82, and between the thigh support frame 82 and the calf support frame 84. The pivoting attachment 60 includes two pivot portions 62 respectively disposed on the adjacent two support arms 32 of the two extension frames 30. Each pivot portion is L-shaped and has a baseplate 63 fixedly attached to the support arm 32, an upright plate 64 extending vertically from the baseplate 63, and a through hole 65 formed at the upright plate 64. The through holes 65 of adjacent two pivot portions 62 are aligned with or aimed at each other and are penetrated by a retaining member 66, which may be a bolt, a pin, or an equivalent member thereof, so that the adjacent extension frames 30 can be folded or unfolded together relative to the main frame 20, and when the actuators 50 drive the main frames 20 to swing relative to the bottom frame 10, the adjacent extension frames 30 can also move together with the main frames 20. Moreover, because multiple extension frames 30 are connected together, the structure of the bed frame 1 becomes more stable.

Based on the above-disclosed technical features of the present invention, various modifications to the width adjustable bed frame 1 may be made. For example, the function of the longitudinal rod 24 is to secure the two transverse extension portions 22 and provide support for the two linkages 40. If other reinforcement rods 26 are present to secure the two transverse extension portions 22, the longitudinal rod 24 can be divided into two, each if which has a structure similar to that of the stopping portions 34 of the 10 extension frame 30, providing a stop function for the two linkages 40. Similarly, the two stopping portions 34 can be combined to form a single member having a structure similar to that of the longitudinal rod 24, thereby also connecting the two support arms 32 to provide a function similar to the longitudinal extension portion 36. These linkages 40 can also be positioned at outer sides of the two transverse extension portions 22 and/or outer sides of the two support arms 32. In this approach, the longitudinal rod 24 and the stopping portion 34 need to extend correspondingly to the outer sides of the two transverse extension portions 22 and the two support arms 32. Furthermore, the top surface of the longitudinal rod 24 only needs to be lower than the top surface of the transverse extension portions 22, and the longitudinal rod 24 does not necessarily need to 20 be located at the bottom edge of the two transverse extension portions 22. Similarly, the top surface of the stopping portion 34 only needs to be lower than the top surface of the support arms 32, and the stopping portion 34 does not necessarily need to be located at the bottom edge of the two support arms 32. The bottom frame 10 may not necessarily have folding function. The quantity and positions of the main frames 20, the extension 25 frames 30, and the linkages 40 may be varied according to requirements. The connecting device 60 may also be replaced with hooks, adhesives, or other structures. The quantity of actuators 50 may be increased, decreased, or even omitted as needed, and the quantity of leg posts 55 may also be adjusted or omitted. Such variations are not to be regarded as a departure from the spirit and scope of the invention, and all such modifications as would 5 be obvious to one skilled in the art are intended to be included within the scope of the following claims.

We claim:

1. A large sized adjustable bed frame configured to be foldable for easy shipping, said adjustable bed frame comprising:

a bottom frame having a top surface and a bottom surface;

a multi-sectional adjustable frame disposed on said bottom frame top surface, said multi-sectional adjustable frame consisting of an adjustable back frame, a first fixed hip frame, a second fixed hip frame, an adjustable thigh frame, and an adjustable calf frame, each of said multi-sectional adjustable frames having a left side and a right side;

a multiplicity of extension frames rotatably attached to the adjustable frames;

wherein said bottom frame consists of a U-shaped front frame and a U-shaped rear frame foldably attached to each other by means of a main frame hinge;

said U-shaped front frame having two front frame arms and a front frame cross bar attached between said front frame arms, and said U-shaped rear frame having two rear frame arms and a rear frame cross bar attached between said rear frame arms, wherein said U-shaped rear frame is smaller than the U-shaped front frame such that said U-shaped rear frame can fold and fit within said U-shaped front frame;

said U-shaped front frame and a U-shaped rear frame further having a top surface and a bottom surface;

wherein said first fixed hip frame is attached to said top surface of said front frame, said adjustable back support frame is rotatably attached to said first fixed him frame, said second fixed hip frame is attached to the top surface of said rear frame, said adjustable thigh frame rotatably attached to said second fixed hip frame, and said adjustable calf frame rotatably attached to said adjustable thigh frame;

wherein said adjustable back frame has a left and right side extension frames foldably attached thereto, said first fixed hip frame has a left and right side first fixed extension frames attached thereto, said second fixed hip frame has a left and a right side second fixed hip extension frames foldably attached thereto, said adjustable thigh frame has a left and right side thigh extension frames foldably attached thereto, and said adjustable calf frame has a left and right side calf extension frames foldably attached thereto;

wherein each of said adjustable frames further have a left and a right side, both sides having:

two transverse extension portions parallel to each other, and a longitudinal rod connected with the two transverse extension portions;

said extension frame having two support arms corresponding in position to the two transverse extension portions of the adjustable frame, and two stopping portions disposed with the two support arms, respectively; and two linkages each having two ends pivotally connected with one of the two transverse extension portions and one of the two support arms in a way that each of the two linkages is abutted against a top edge of one of the stopping portions and a top edge of one of the longitudinal rods;

wherein the extension frame is upwardly foldable together with the two linkages to swing to a top side of the adjustable frame in a way that the two support arms are in contact with the two transverse extension portions, thereby reducing the overall width of the bed frame, with a minimal increase in thickness of the folded frame;

wherein said extension frames fold against a top surface of said adjustable frames to reduce the width of the frame with minimal thickness;

and wherein when said adjustable frames are folded flat, said extension frames are folded onto said adjustable frames, and said bottom frames are folded together, the overall dimensions of the bed frame are of a size to accommodate shipping.

2. The adjustable bed frame of claim 1 wherein the two linkages are located between the two transverse extension portions and the two support arms.

3. The adjustable bed frame of claim 2 wherein the two stopping portions extend outwardly from the two support arms towards each other.

4. The adjustable bed frame of claim 3 wherein the two stopping portions are provided at bottom edges of the two support arms, respectively.

5. The adjustable bed frame of claim 4 wherein the longitudinal rod is provided at bottom edges of the two transverse extension portions, respectively.

6. The adjustable bed frame of claim 1, further including a multiplicity of leg posts removably attached to said bottom frame bottom surface.

7. The adjustable bed frame of claim 1, further comprising:

a back frame actuator disposed between said adjustable back frame and said bottom frame top surface to allow the rotatable movement of said adjustable back frame on said first fixed hip frame to allow the adjustment of said adjustable back frame; and a thigh frame actuator disposed between said adjustable thigh frame and said bottom frame top surface to allow the rotatable movement of said adjustable thigh frame on said second fixed hip frame to allow the adjustment of said adjustable thigh frame.

* * * * *